US010390599B1

(12) United States Patent
James et al.

(10) Patent No.: US 10,390,599 B1
(45) Date of Patent: Aug. 27, 2019

(54) HAIR GATHERING ACCESSORY WITH HEAT SHIELD

(71) Applicants: Denise James, Wellington, FL (US); Ronald Lanclos, Wellington, FL (US)

(72) Inventors: Denise James, Wellington, FL (US); Ronald Lanclos, Wellington, FL (US)

( * ) Notice: Subject to any disclaimer, the term of this patent is extended or adjusted under 35 U.S.C. 154(b) by 0 days.

(21) Appl. No.: 16/130,598

(22) Filed: Sep. 13, 2018

(51) Int. Cl.
*A45D 20/08* (2006.01)
*A45D 24/10* (2006.01)
*A45D 8/00* (2006.01)
*A45D 6/00* (2006.01)

(52) U.S. Cl.
CPC ..... *A45D 24/10* (2013.01); *A45D 8/00* (2013.01); *A45D 2006/005* (2013.01)

(58) Field of Classification Search
CPC ..... A45D 24/00; A45D 24/04; A45D 24/08; A45D 24/10; A45D 24/36; A45D 24/38; A45D 2024/002; A45D 2006/005; A45D 8/00
See application file for complete search history.

(56) References Cited

U.S. PATENT DOCUMENTS 1,960,990 A 5/1934 De Bellis
2,288,299 A * 6/1942 Pileggi ..... B26B 21/125 132/148
2,461,170 A * 2/1949 Morretta ..... A45D 2/42 132/122
2,900,718 A * 8/1959 Bailey ..... B26B 21/125 30/296.1
3,599,327 A * 8/1971 Calandra ..... A45D 24/10 30/30
3,926,200 A 12/1975 Losenno
3,963,034 A 6/1976 Runberg et al.
4,020,549 A * 5/1977 Edwards ..... A45D 24/36 30/140
D248,996 S * 8/1978 Brunas ..... D4/136
4,285,087 A 8/1981 Sapronetti
4,401,129 A * 8/1983 Luque ..... B26B 21/125 132/213.1
5,664,588 A 9/1997 Berry
7,146,985 B1 12/2006 Harris
7,337,902 B2 * 3/2008 Rosdal ..... A45D 6/00 206/349
8,132,573 B1 3/2012 Jones
2008/0127989 A1 6/2008 Chapman et al.
2008/0264439 A1 10/2008 Braud
2011/0056505 A1 * 3/2011 Parkinson ..... A45D 20/525 132/120

(Continued)

FOREIGN PATENT DOCUMENTS

JP 2005143846 6/2005

*Primary Examiner* — Nicholas D Lucchesi
(74) *Attorney, Agent, or Firm* — Scott D. Smiley; Scott M. Garrett; The Concept Law Group, PA

(57) ABSTRACT

A hair gathering accessory can be formed as a comb or a brush device, and has a handle formed with a body. On one side of the body are a plurality of tines (e.g. comb teeth, brush bristles, etc.). On the other side of the body is a heat shield that is attached to the body and which extends away from the body some distance. The tines are used to gather a portion of hair while the hair gathering accessory is being held by a person, and the heat shield protects the person whose hair has been gathered from the heat of a hair iron that is applied to the gathered portion of hair.

12 Claims, 13 Drawing Sheets

(56) References Cited

U.S. PATENT DOCUMENTS

| | | | | |
|---|---|---|---|---|
| 2011/0180013 | A1* | 7/2011 | Kissel, Jr. | A01K 13/002 119/609 |
| 2014/0026822 | A1* | 1/2014 | Harris, II | A01K 13/002 119/628 |
| 2014/0318567 | A1 | 10/2014 | Douglas | |
| 2014/0331504 | A1* | 11/2014 | Michel | B26B 19/3813 30/233.5 |
| 2015/0320172 | A1* | 11/2015 | Spencer | B26B 21/12 30/30 |
| 2016/0058159 | A1 | 3/2016 | Groesbeck | |
| 2017/0119125 | A1* | 5/2017 | Davis | A45D 24/14 |
| 2017/0355090 | A1* | 12/2017 | Spencer | B26B 21/12 |

* cited by examiner

HAIR GATHERING ACCESSORY WITH HEAT SHIELD

FIELD OF THE INVENTION

The present invention relates generally to hair styling tools, and, more particularly, relates to a hair styling tool for arranging and engaging a portion of a person's hair to be further engaged with a heated styling tool such as a curling iron, and the hair styling tool includes a shield for preventing inadvertent contact between the heated styling tool and the person's skin.

BACKGROUND OF THE INVENTION

There are a wide variety of hair styling tools available in the market, including passive tools like combs, brushes, and clips, and active tools such as dryers and irons. Often these are used together. For example, it is common to use a comb or brush to gather a portion of hair, and then apply a curling iron to the gathered hair to curl the hair. It is well known that care must be exercised when using a curling iron because a typical curling iron heats to a temperature high enough to cause burn damage on skin. Still, despite being careful, people can still inadvertently burn themselves, or the person on whom they are using the tools.

In order to address the risk of causing a burn when using a hair iron, a number of devices have been developed to act as a shield or barrier between the person and the hot iron. These devices generally take one of three forms; they are held by the non-iron hand, they are affixed to the hair, or they are attached to the iron. If the barrier device is hand held, then the other hand has to hold the iron, leaving the operator to carefully gather hair with the iron. If the barrier is placed in the hair, then the person or the stylist can use both hands, but the barrier doesn't move with the stylist's hands. If the barrier is attached to the iron, then the maneuverability of the iron is limited.

Therefore, a need exists to overcome the problems with the prior art as discussed above.

SUMMARY OF THE INVENTION

The invention provides a hair gathering accessory that overcomes the hereinafore-mentioned disadvantages of the heretofore-known devices and methods of this general type and that includes a heat shield that protects a person from burns when using a hair iron or other heated hair styling implement.

In accordance with embodiments of the inventive disclosure, there is provided a hair styling accessory that includes a body having a plurality of tines extending away from the body in a first direction relative to the body. The hair styling accessory can further include a handle extending from the body and being longitudinally aligned with the body. The hair styling accessory can further include a heat shield attached to the body, opposite the plurality of tines, and extending away from the body in a second direction which is opposite the first direction, wherein the heat shield is heat resistant to a temperature of at least four hundred degrees and is more flexible than a material of the body.

In accordance with a further feature, the plurality of tines are comb teeth.

In accordance with a further feature, the heat shield is made of silicone rubber.

In accordance with a further feature, the heat shield is attached to the body by being overmolded onto a retaining portion of the body that extends into the heat shield.

In accordance with a further feature, the heat shield is removably attached to the body, and includes a first foot at a first end of the heat shield, and a second foot at a second end that is opposite the first end, wherein the first foot and second foot are configured to engage corresponding pocket features in the body to retain the heat shield on the body.

In accordance with a further feature, the heat shield tapers towards a distal edge of the heat shield.

In accordance with a further feature, the heat shield is retained on the body by a retaining flange at a base of the heat shield that is slid into a retaining groove formed in the body, and wherein the retaining flange and retaining groove have interference features that prevent the heat shield from moving away from the body in the second direction.

In accordance with other embodiments of the inventive disclosure, there is provided a hair gathering accessory that includes an elongated body, a handle extending away from the elongated body in an elongated direction of the body, a plurality of tines disposed on a first side of the elongated body and extending away from the elongated body in a first direction, and a heat shield on a second side of the elongated body, opposite the first side and the plurality of tines, and extending away from the body in a direction opposite of the plurality of tines.

In accordance with a further feature, the plurality of tines are uniform comb teeth.

In accordance with a further feature, the plurality of tines are brush bristles.

In accordance with a further feature, the heat shield is made of silicone rubber.

In accordance with a further feature, the heat shield is overmolded onto a retention feature extending from the body opposite the plurality of tines, and along the body substantially parallel to the elongated direction of the body, and which has at least one retention through hole.

In accordance with a further feature, the wherein the heat shield is removably attached to the body, and includes a first foot at a first end of the heat shield, and a second foot at a second end that is opposite the first end, wherein the first foot and second foot are configured to engage corresponding pocket features in the body to retain the heat shield on the body.

In accordance with a further feature, the heat shield is retained on the body by a retaining flange at a base of the heat shield that is slid into a retaining groove formed in the body and along the body parallel to the elongated direction of the body, and wherein the retaining flange and retaining groove have interference features that prevent the heat shield from moving away from the body in the second direction.

In accordance with a further feature, the heat shield tapers towards a distal edge of the heat shield.

In accordance with other embodiments of the inventive disclosure, there is provided a comb device that includes a body having an elongated direction and a length in the elongated direction, a plurality of comb teeth extending from a first side of the body and spanning a length along the first side substantially equal to the length of the body, a handle extending from the body along the elongated direction that is configured to be gripped by a user, and a heat shield attached to the body as a second side of the body that is opposite the first side relative to the elongated direction, and which has a length substantially equal to the length of the body, and wherein the heat shield is made of silicone rubber.

In accordance with a further feature, the heat shield is overmolded onto a retention feature extending from the body opposite the plurality of tines, and along the body substantially parallel to the elongated direction of the body, and which has at least one retention through hole.

In accordance with a further feature, the wherein the heat shield is removably attached to the body, and includes a first foot at a first end of the heat shield, and a second foot at a second end that is opposite the first end, wherein the first foot and second foot are configured to engage corresponding pocket features in the body to retain the heat shield on the body.

In accordance with a further feature, the heat shield is retained on the body by a retaining flange at a base of the heat shield that is slid into a retaining groove formed in the body and along the body parallel to the elongated direction of the body, and wherein the retaining flange and retaining groove have interference features that prevent the heat shield from moving away from the body in the second direction.

In accordance with a further feature, the heat shield tapers towards a distal edge of the heat shield.

Although the invention is illustrated and described herein as embodied in a hair gathering accessory, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time.

"In the description of the embodiments of the present invention, unless otherwise specified, azimuth or positional relationships indicated by terms such as "up", "down", "left", "right", "inside", "outside", "front", "back", "head", "tail" and so on, are azimuth or positional relationships based on the drawings, which are only to facilitate description of the embodiments of the present invention and simplify the description, but not to indicate or imply that the devices or components must have a specific azimuth, or be constructed or operated in the specific azimuth, which thus cannot be understood as a limitation to the embodiments of the present invention. Furthermore, terms such as "first", "second", "third" and so on are only used for descriptive purposes, and cannot be construed as indicating or implying relative importance.

In the description of the embodiments of the present invention, it should be noted that, unless otherwise clearly defined and limited, terms such as "installed", "coupled", "connected" should be broadly interpreted, for example, it may be fixedly connected, or may be detachably connected, or integrally connected; it may be mechanically connected, or may be electrically connected; it may be directly connected, or may be indirectly connected via an intermediate medium. As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. In this document, the term "longitudinal" should be understood to mean in a direction corresponding to an elongated direction of the hair styling accessory. Those skilled in the art can understand the specific meanings of the above-mentioned terms in the embodiments of the present invention according to the specific circumstances.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DETAILED DESCRIPTION

Figure 1:
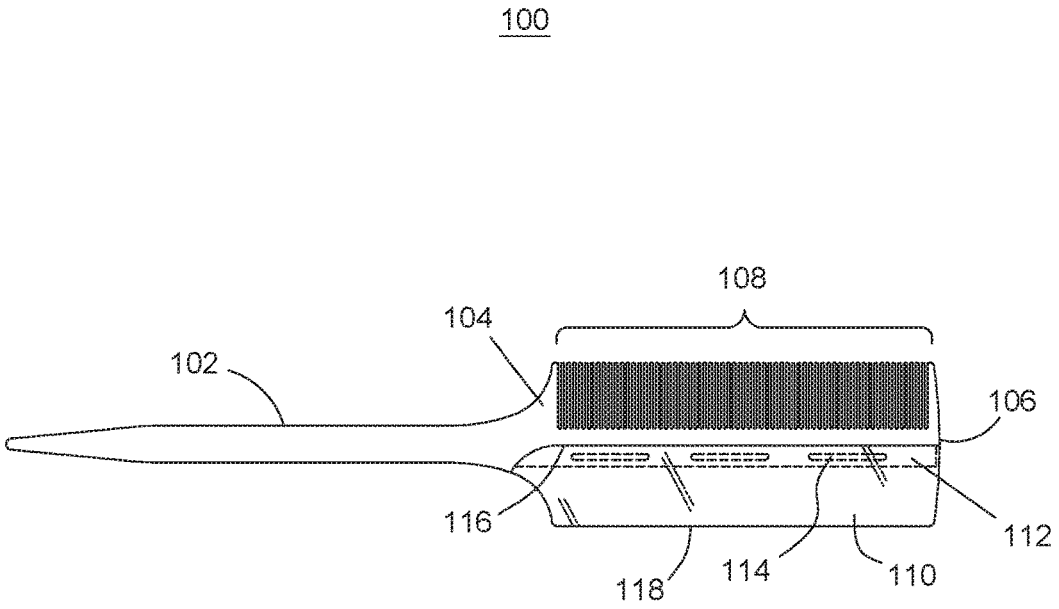
FIG. 1 is a plan view of a hair gathering accessory having a heat shield, in accordance with some embodiments.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

The present invention provides a novel and efficient hair gathering accessory having a heat shield to allow the use of a hair iron on a portion of a person's hair, where the heat shield that is integrally coupled, connected, or formed with the hair gathering accessory protect the person from the heat of the hair iron and inadvertent contact between the hair iron and the person's skin, which could otherwise cause a painful (or worse) burn. Some embodiments are configured in the form of a comb device, while other embodiments are configured in the form of a brush device.

FIGS. 1-4 represent substantially similar embodiments, and use the same reference numerals to refer to similar or the same structure. The hair gathering accessory in each of FIGS. 1-4 can be the same hair gathering accessory. As used here, a hair gathering accessory is a device or structure that uses tines, teeth, bristles, or other similar structures to engage a portion of a person's hair, thereby gathering the portion of the person's hair so that the person, or another person, can apply a treatment to the gathered portion of hair, such as applying a hair iron to the gathered portion of hair. Combs and brushes are often used in this manner to gather hair, and can further be used to comb/brush the hair.

Figure 2:
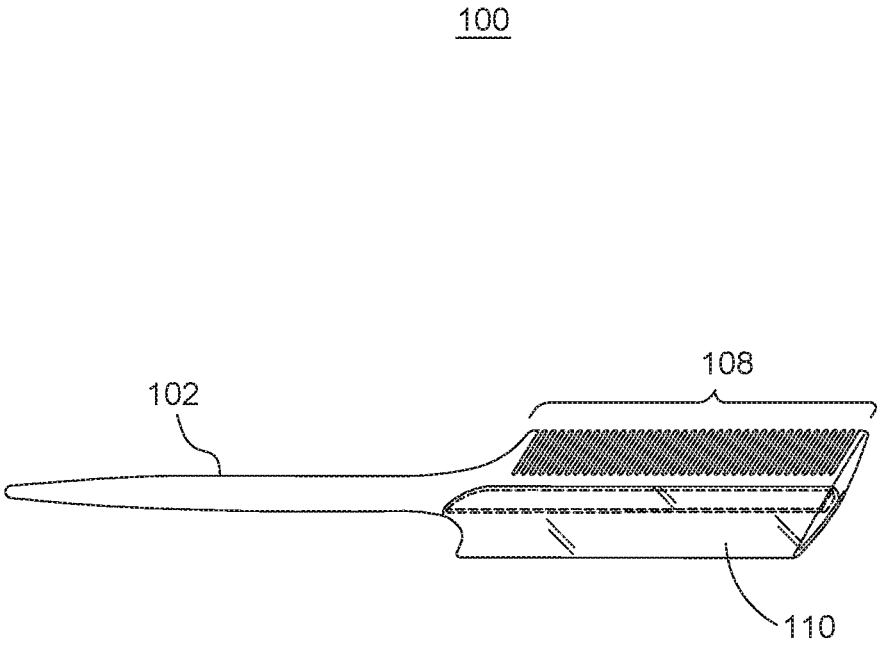
FIG. 2 is an isometric perspective view of a hair gathering accessory having a heat shield, in accordance with some embodiments.
Figure 3:
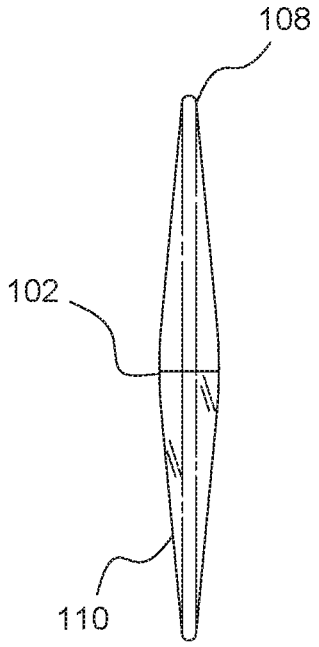
FIG. 3 is an end view of a hair gathering accessory having a heat shield, in accordance with some embodiments.
Figure 4:
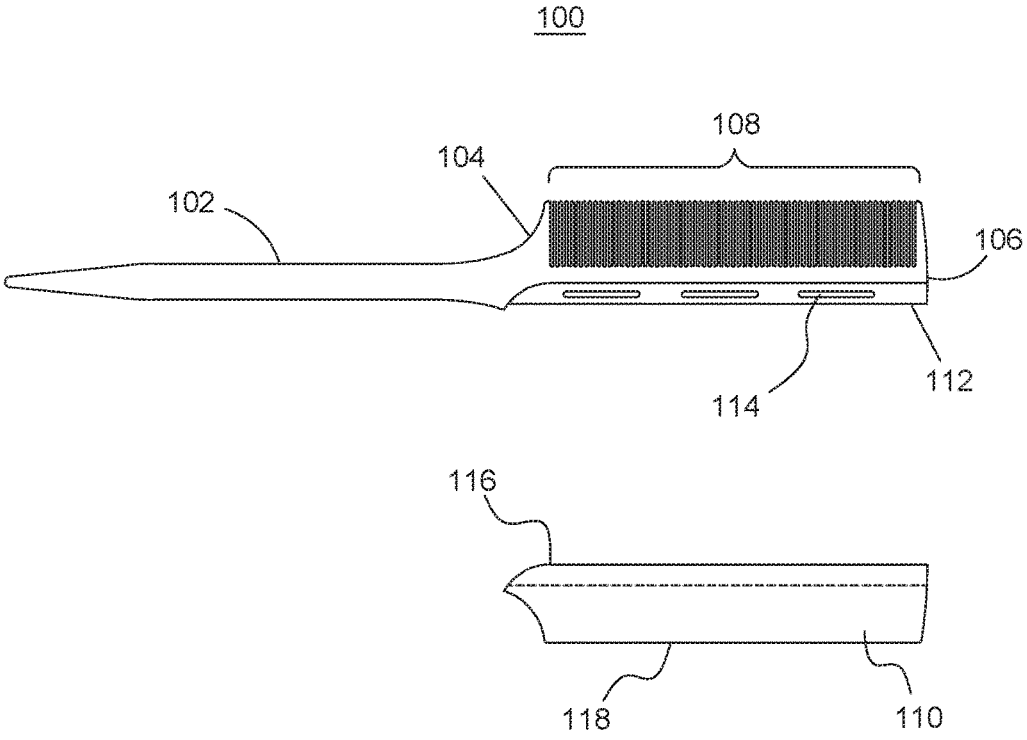
FIG. 4 is an exploded plan view of a hair gathering accessory having a heat shield, in accordance with some embodiments.

FIG. 1 is a plan view of a hair gathering accessory 100 having a heat shield, in accordance with some embodiments. In particular the hair gathering accessory 100 is shown in the form of a comb device. FIGS. 2-4 show an isometric perspective view, an end view, and an exploded plan view of the hair gathering accessory 100, respectively, in accordance with some embodiments. The hair gathering accessory 100 includes a handle 102 that extends from a body 104 along an elongated direction away from the body 104, and is configured to be gripped by a person. The body 104 and handle 102 can be integrally formed of the same material, such as a thermoplastic that is molded into the desired shape. The body 104 extends from the handle 102 to the opposite end 106 of the body 104 from the handle 102. Along one side of the body 104 are a plurality of tines 108 or similar structures for engaging a portion of a person's hair. The tines 108 can likewise be integrally formed with the body 104 and can take the form of teeth, bristles, or similar structures, as are known. As shown in FIG. 104, the tines 108 provided in the form of comb teeth that are all of about equal length and having regular spacing and equivalent thickness/width.

Opposite the tines 108 is a heat shield 110 that is coupled to the body 104. The heat shield 110 can be formed of a heat resistant material that is more flexible than the material used to form the handle 102, body 104, and tines 108. For example, the heat shield 110 can be formed of silicone rubber such as that commonly used in cooking implements. In order to retain the heat shield 110 on the body 104, the heat shield 110 can be overmolded onto a retention feature 112 that can be an extension on a spine of the body 104. The retention feature 112 will be inside a portion of the heat shield 110, and through holes or openings 114 in the retention feature allow the material of the heat shield 110 to pass through the retention feature 112, fixing the heat shield onto the retention feature 112 permanently. The base 116 of the heat shield 110 abuts the body 104 along the length of the body 104. The edge 118 of the heat shield is opposite the base 116, and in some embodiments can have a width in the range of 0.75-1.5 inches, and more or less in other embodiments. The material of the heat shield 110 can be colored, translucent, or opaque. The heat shield 110 further can have a length along the edge 118 parallel to the body that is substantially equal to a length spanned by the tines 108.

In FIG. 4 the heat shield 110 is shown apart from the body 104 for exemplary purposes only. This is not to imply that the specific embodiment represented by FIGS. 1-4 are assemble as separate pieces, but rather to show the detail of the retention feature 112 and openings 114 without the heat shield 110 obscuring the view of these features. However, in some embodiments, the heat shield 110 can be provided as a separate piece that is attached to the body 104 such as by an adhesive, or by mechanical means.

Figure 5:
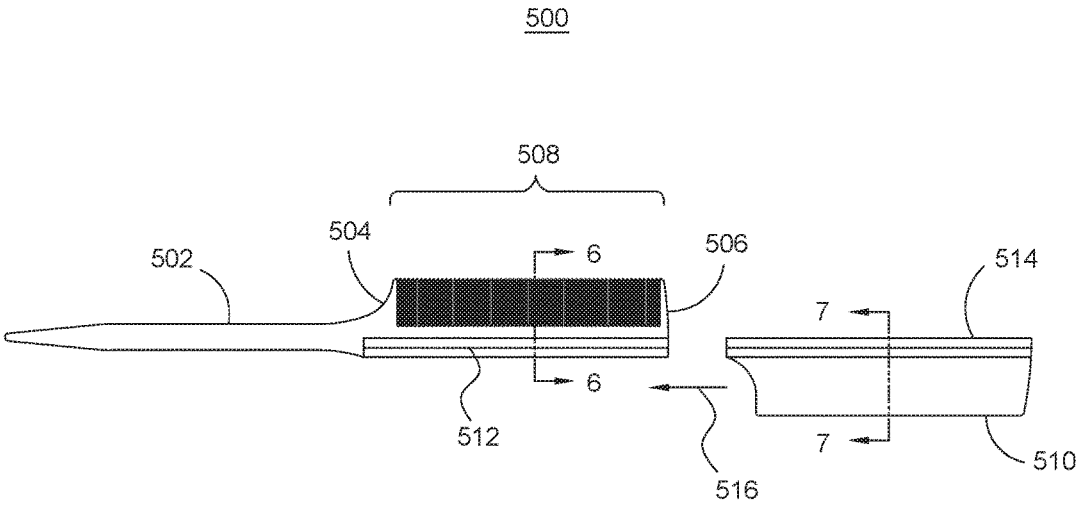
FIG. 5 is a view of a disassembled hair gathering accessory having a heat shield, in accordance with some embodiments.
Figure 6:
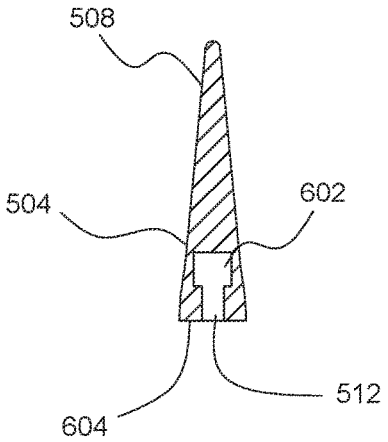
FIG. 6 is a cross sectional end view of a body of a hair gathering accessory, in accordance with some embodiments.
Figure 7:
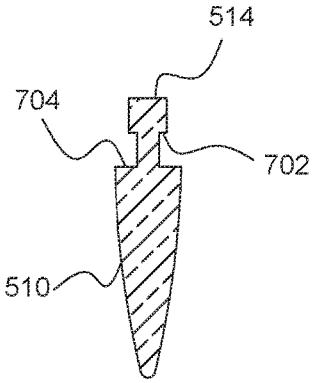
FIG. 7 is a cross section end view of a heat shield for use with a hair gathering accessory, in accordance with some embodiments.

FIG. 5 is a view of a disassembled hair gathering accessory 500 having a heat shield 510, in accordance with some embodiments. Specifically, embodiments represented by FIG. 5, the heat shield 510 is retained on the body 504 by mechanical means. The hair gathering accessory 500 includes a handle 502 coupled to the body 504 and extending away from the body 504. The body further comprises a plurality of tines 508 that are uniformly arranged on one side of the body 504 between the end of the handle 502 and the end 506 of the body 504. The body 504 includes a longitudinal retaining groove 512 into which a corresponding retaining flange 514 on the base of the heat shield 510 fits by sliding the retaining flange 514 into and along the retaining groove 512 as indicated by arrow 516. FIGS. 6 and 7 show cross sectional end view taken along line AA and BB, respectively, to show the detail of the retaining groove 512 and retaining flange 514.

FIG. 6 shows a cross sectional end view of the body of the hair gathering accessory, include a tine 508 that extends from a body 504 of the hair gathering accessory. A retaining groove 512 is formed as a channel along the body 504, opening at the end 506 of the body 504. The retaining groove 512 is formed with a wider portion in the body 504 that creates an interior shoulder 602 next to a narrower portion of the channel. An exterior shoulder 604 is formed on the outside of the body 504 along both sides of the channel. FIG. 7 shows an cutaway end view of a heat shield having a retaining flange 514 that interfaces with the retaining groove 512, and has a cross sectional shape that corresponds to the cross sectional shape of the retaining groove 512. Specifically, the retaining flange 514 forms an interior shoulder 702 that interfaces with interior should 602 of the retaining groove 512 to create a mechanical interference that retains the heat shield 510 in the retaining groove 512. The heat shield 510 can also include an exterior shoulder 704 that interfaces with the exterior should 604 of the retaining groove 512 to form a smooth transition from the body 504 to the heat shield 510. Other equivalent arrangements of such tongue and groove retention configurations can be used, as will occur to those skilled in the art.

Figure 8:
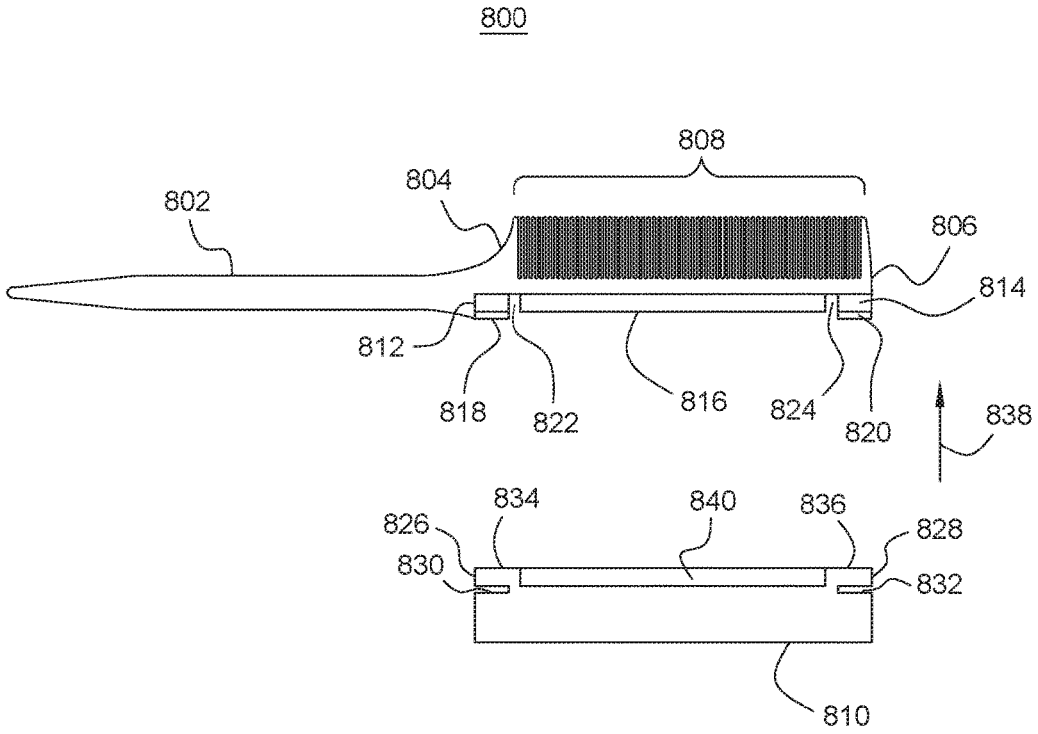
FIG. 8 is a view of a disassembled hair gathering accessory having a heat shield, in accordance with some embodiments.

FIG. 8 is a view of a disassembled hair gathering accessory 800 having a heat shield 810, in accordance with some embodiments. The hair gather accessory 800 can be provided in the same form factor as that shown in FIGS. 1-5, but uses an alternative structure to retain the heat shield 810 into the body 804. Accordingly, the hair gathering accessory 800 includes an elongated handle 802 that extends from the body 804 and is configured to be grasped by a person while operating or using the hair gathering accessory 800. The body has a plurality of tines 808 that extend away from the body and which are configured to engage a portion of a person's hair. The tines 808 span the body 804 from near the handle 802, where the handle 802 meets the body 804, to near the end 806, in a conventional configuration.

To retain the heat shield 810, which can be made of, for example, silicone rubber, the heat shield 810 includes some interlocking retention features that mate with corresponding features on the body 804, opposite the tines 808. The body 804 forms a first pocket 812 and a second pocket 814. The pockets 812, 814 are at opposite ends of the heat shield 810 to body 804 interface site on the body 804, and have openings that face each other, along the elongated direction of the body 804. That is, the pockets 812, 814 are recesses that are covered along the back of the body 804 by portions 818, 820, respectively. Between the pockets 812, 814 is a support insert 816 that fits within a groove or channel 840 formed in the base of the heat shield 810. The heat shield further includes foot portions 826 and 828 that correspond with, and fit into pockets 812, 814, respectively.

To attach the heat shield 810 to the body 804, as indicated by arrow 838, foot portion 826 can be first inserted into a gap 822 between an end of the support insert 816 and the first pocket 812, and then the foot portion 826 is then maneuvered into the first pocket 812 such that portion 818 fits into recess 830 in the heat shield 810. Likewise, foot portion 828 can be inserted into gap 824 and maneuvered into second pocket 814 such that portion 820 fits within recess 832 in the heat shield. Recesses 830 and 832 define the respective foot portions 826, 828. After placing foot portions 826, 828 into pockets 812, 814, support insert 816 will be inside channel 840 in the heat shield 810 to provided lateral support and prevent the central portion of the heat shield 810 from moving transversely (i.e. in a direction that is in or out of the page, as shown here). Portions 818, 820 form an interference with foot portions 826, 828 when in recesses 830, 832, thereby retaining the heat shield 810 onto the body 804.

Figure 9:
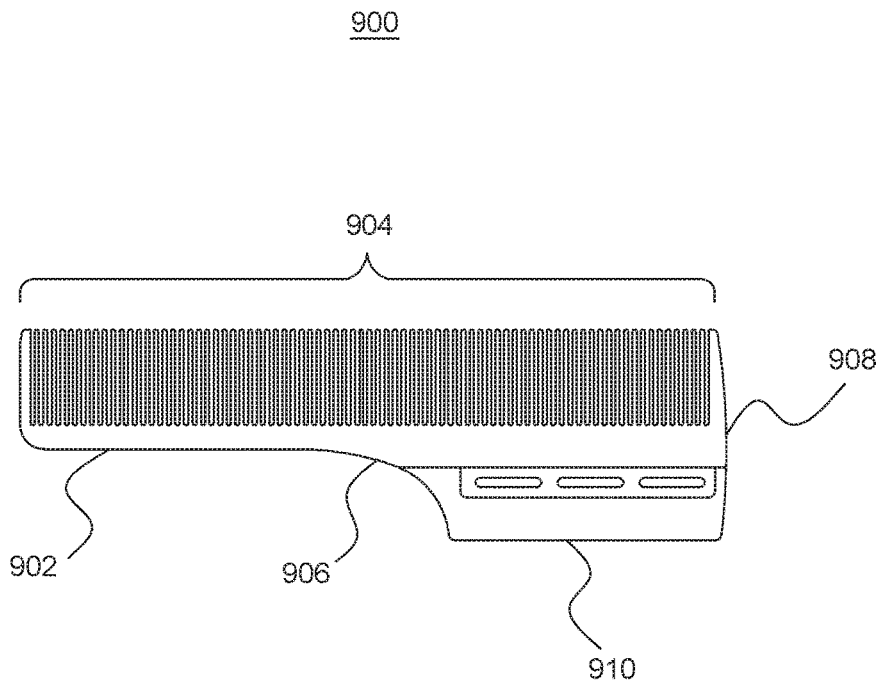
FIG. 9 is a plan view of a hair gathering accessory having a heat shield and a full comb, in accordance with some embodiments.

FIG. 9 is a plan view of a hair gathering accessory 900 having a heat shield 910 and a full comb, in accordance with some embodiments. The hair gathering accessory 900 here is formed generally as comb having a plurality of tines 904 that span substantially the full length of a body 906, along a portion 902 that can act as a handle or place to hold the accessory 900, to an end 908. The heat shield 910 can be attached to the body 906 by means such as those described in FIGS. 1-8 or equivalent means. In embodiments represented by structures like that shown here in FIG. 9, the hair gathering accessory 900 provides the benefit of a longer comb section, while still providing the benefit of a heat shield.

Figure 10:
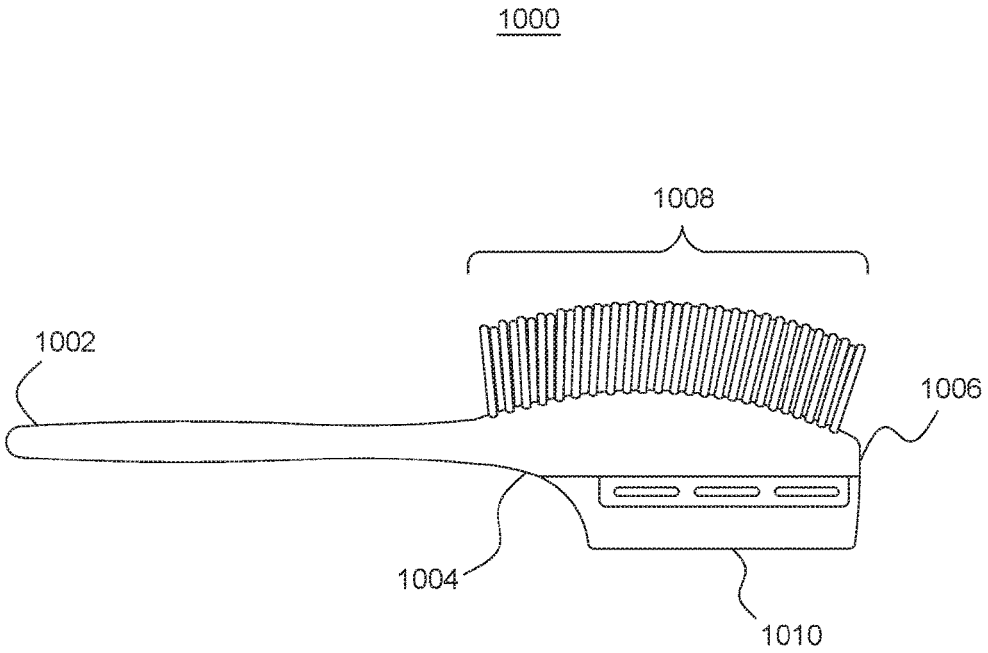
FIG. 10 is a plan view of a hair gathering accessory having a heat shield in an embodiment that includes a brush, in accordance with some embodiments.

FIG. 10 is a plan view of a hair gathering accessory 1000 having a heat shield 1010 in an embodiment that includes a brush, in accordance with some embodiments. The brush 1000 includes an elongated handle which extends from a body 1004 of the brush 1000. A plurality of brush bristles 1008 can be disposed on one side of the brush body 1004 along the body from the point where the handle 1002 joins the body 1004 to an end 1006 (e.g. a distal end). The heat shield 1010 can be attached to the body 1004 using any of the structures and techniques described herein, or equivalent structures. Given the various types of hair, it may desirable in some circumstance to have a brush instead of a comb.

In use, a hair gathering accessory as exemplified by embodiments represented by FIGS. 1-10, includes a heat shield on a body of the hair gathering accessory that is positioned opposite the hair engaging tines (e.g. teeth, bristles). This allows a person to use the hair gathering accessory to gather a portion of hair on a person's head (e.g. their own head or, as a hair stylist, someone else's head) for treatment with a hair iron. The hair iron can engage the gathered portion of hair close to the hair gathering accessory, over the heat shield. The heat shield is capable of withstanding very high temperatures (e.g. over 500 degrees F.), and so prevents burns that would otherwise occur due to inadvertent contact between the hot hair iron and the person's scalp or other part of the head. The heat shield can have a cross section similar to a blade, where is it wider at the base where it joins to the body of the hair gathering accessory, and then tapers to an edge at the portion farther from the body of the hair gathering accessory. The heat shield generally extends along the body of the hair gathering accessory (i.e. less that the entire length of the hair gathering accessory), but it is contemplated that, in some embodiments, the heat shield can extend along the handle as well. For example, in embodiments represented by FIG. 9, the heat shield 910 can extend along the handle 902, in effect making the handle 902 and body 906 indistinguishable from each other. In some embodiments the heat shield can have a length of about four inches (i.e. along the elongated direction of the body), and in some embodiments the heat shield can have a width, from its base to the edge, of about 1.1 inches. In some embodiments the heat shield can have a base of about 0.2 inches, and taper down towards the outside edge.

Figure 11:
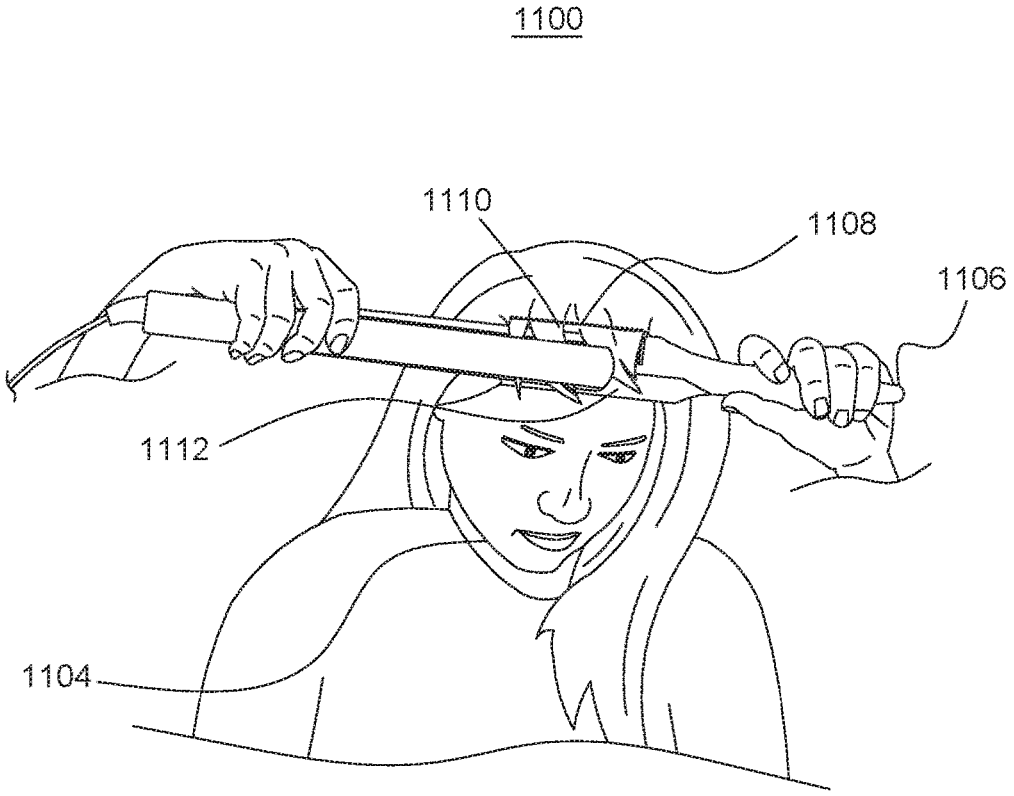
FIG. 11 shows a person using a hair gathering accessory having a heat shield with a hair iron, in accordance with some embodiments.

FIG. 11 shows an example 1100 of a person 1104 using a hair gathering accessory 1106 having a heat shield 1112 with a hair iron 1102, in accordance with some embodiments. The hair gathering accessory 1106 can be designed equivalently to any embodiments represented by FIGS. 1-10, and includes a plurality of tines 1110 used to gather a portion of hair 1108 that is engaged by the heated portion of a hair iron 1102, over the heat shield 1112. The heat shield 1112 provides a heat resistant barrier between the heated portion of the hair iron 1102 and the bare skin of the user 1104. The hair gathering accessory 1106 and the hair iron 1102 can be operated by the user 1104, or by another person who is styling the hair of the user 1104.

Figure 12:
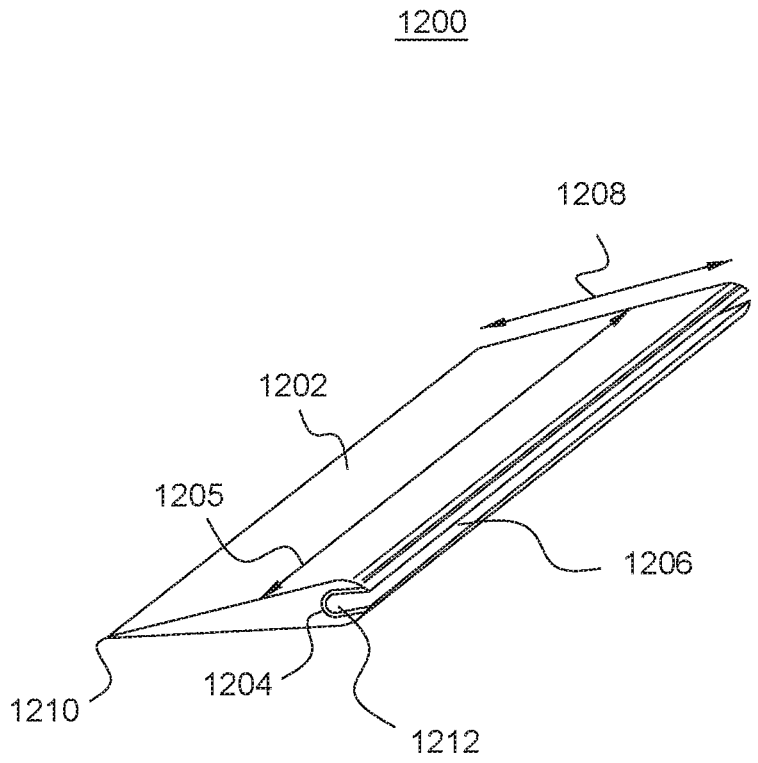
FIG. 12 is a perspective view of a heat shield for use with a hair gathering accessory, in a clip-on form factor, in accordance with some embodiments.
Figure 13:
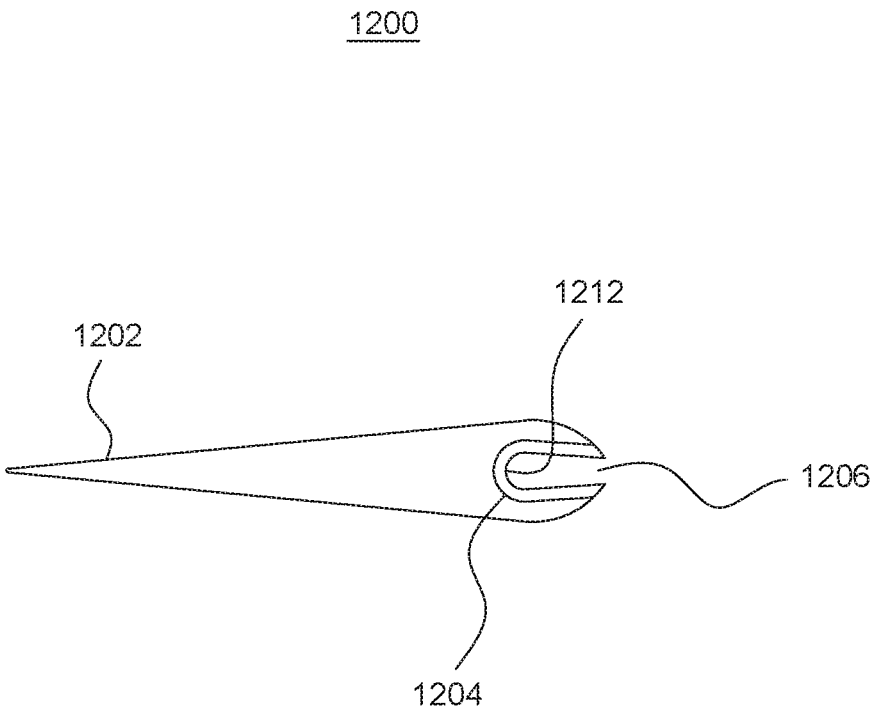
FIG. 13 is an end view of a heat shield for use with a hair gathering accessory, in a clip-on form factor, in accordance with some embodiments.

FIG. 12 is a perspective view of a heat shield 1200 for use with a hair gathering accessory, in a clip-on form factor, in accordance with some embodiments. The heat shield 1200 is further shown in FIG. 13-14 as well. The heat shield comprises a heat resistant portion 1202 that is comprised of a material such as silicone rubber, and is generally blade-shaped, have a length 1205, and a width 1208. The length 1205 can correspond approximated to the length of a set of tines in a hair gathering accessory such as a comb. The width 1208 can be on the order of three quarters of an inch to two inches wide, or more or less in some embodiments. The heat shield 1200 can taper to a distal edge 1210. The heat resistant portion 1202 can be molded over an elongated "C" clip 1204 to form an engagement edge. The "C" clip 1204 can be made of a different material than the heat resistant portion 1202, such as plastic or metal with a spring property to the material. In some embodiments the "C" clip 1204 can be simply a "C" shaped portion of the heat resistant portion 1202. The "C" clip 1204 runs the length 1205 of the heat shield 1200, and is designed to frictionally engage the back edge of a comb, and to provided sufficient clamping force to retain the heat shield 1200 on the back edge of the comb. Accordingly, the interior of the "C" shaped clip can be sized to accommodate the thickness of the back edge of the comb, while the opening 1206 can be narrower than the back edge of the comb to naturally provide force against the comb body when placed on the comb.

Figure 14:
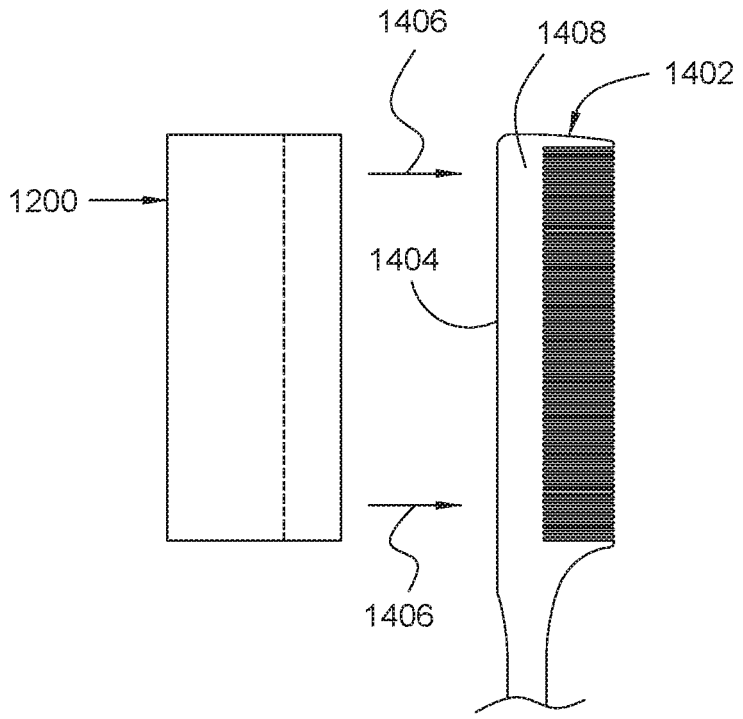
FIG. 14 is a view of a heat shield for use with a hair gathering accessory, in a clip-on form factor, being assembled onto a comb, in accordance with some embodiments.

In FIG. 14 the heat shield 1202 is shown apart from a comb 1402, to be assembled onto the comb at a back edge 1404 of the comb. The back edge 1404 can be pressed into the opening (1206) of the heat shield, as indicated by arrows 1406, until the back edge 1404 of the comb is against a corresponding back 1212 of the "C" clip 1204. The portion of the "C" clip between the opening 1206 and the back 1212 will then be forced into frictional engagement with the surface of the body 1408 of the comb 1402, and thereby the heat shield will be retained on the comb 1402. In some embodiments the comb 1402 can have a body 1408 that has a cross sectional profile to match the interior of the "C" shaped clip.

A hair gathering accessory has been disclosed that includes a plurality of tines on one side of a body of the hair gathering accessory, and a heat shield on a side opposite the plurality of tines which extends away from the body of the hair gathering accessory. The heat shield is made of a heat resistant, flexible material (more flexible than the material used to make the body of the hair gathering accessory) this is also heat resistant, and able to withstand the temperatures of styling tools such as hair irons, for example. The disclosed embodiments of the hair gathering accessory and equivalent devices provide the benefit of allowing a user to gather hair conventionally using the tines, and also providing a heat shield that moves with the hair gathering accessory, unlike prior art heat barriers that attach independently to the hair and have to be moved independently to the hair gathering accessory. The disclosed hair gathering accessory also provides a benefit over heat shields mounted on a styling device like a curling iron because operating the curling iron then requires carefully arranging the hair so that the iron is applied at the desired place along the hair, and the integral shield is oriented towards the person whose hair is being styled.

What is claimed is:

1. A hair styling accessory, comprising:

a body having a plurality of tines extending away from the body in a first direction relative to the body;

a handle extending from the body and being longitudinally aligned with the body; and a heat shield attached to the body, opposite the plurality of tines, and extending away from the body in a second direction which is opposite the first direction, wherein the heat shield is heat resistant to a temperature of at least four hundred degrees and is more flexible than a material of the body;

wherein the heat shield is removably attached to the body, and includes a first foot at a first end of the heat shield, and a second foot at a second end that is opposite the first end, wherein the first foot and second foot are configured to engage corresponding pocket features in the body to retain the heat shield on the body.

2. The hair styling accessory of claim 1, wherein the plurality of tines are comb teeth.

3. The hair styling accessory of claim 1, wherein the heat shield is made of silicone rubber.

4. The hair styling accessory of claim 1, wherein the heat shield tapers towards a distal edge of the heat shield.

5. A hair gathering accessory, comprising:

an elongated body;

a handle extending away from the elongated body in an elongated direction of the body;

a plurality of tines disposed on a first side of the elongated body and extending away from the elongated body in a first direction; and a heat shield on a second side of the elongated body, opposite the first side and the plurality of tines, and extending away from the body in a direction opposite of the plurality of tines;

wherein the heat shield is overmolded onto a retention feature extending from the body opposite the plurality of tines, and along the body substantially parallel to the elongated direction of the body, and wherein the retention feature has at least one retention through hole through which material of the heat shield passes to retain the heat shield on the retention feature.

6. The hair gathering accessory of claim 5, wherein the plurality of tines are uniform comb teeth.

7. The hair gathering accessory of claim 5, wherein the plurality of tines are brush bristles.

8. The hair gathering accessory of claim 5, wherein the heat shield is made of silicone rubber.

9. The hair gathering accessory of claim 5, wherein the heat shield has a blade shaped cross section.

10. The hair gathering accessory of claim 5, wherein the heat shield tapers towards a distal edge of the heat shield.

11. A comb device, comprising:

a body having an elongated direction and a length in the elongated direction;

a plurality of comb teeth extending from a first side of the body and spanning a length along the first side substantially equal to the length of the body;

a handle extending from the body along the elongated direction that is configured to be gripped by a user; and a heat shield attached to the body as a second side of the body that is opposite the first side relative to the elongated direction, and which has a length substantially equal to the length of the body, and wherein the heat shield is made of silicone rubber, wherein the heat shield is overmolded onto a retention feature extending from the body opposite the plurality of tines, and along the body substantially parallel to the elongated direction of the body, and wherein the retention feature has at least one retention through hole through which material of the heat shield passes to retain the heat shield on the retention feature.

12. The comb device of claim 11, wherein the heat shield tapers towards a distal edge of the heat shield.

* * * * *